US006041843A

United States Patent [19]

Mullet

[11] Patent Number: 6,041,843

[45] Date of Patent: Mar. 28, 2000

[54] COLLAPSIBLE CASCADING IMPACT-RESISTANT DOOR

[75] Inventor: Willis J. Mullet, Pensacola Beach, Fla.

[73] Assignee: Wayne-Dalton Corp., Mt. Hope, Ohio

[21] Appl. No.: 09/046,971

[22] Filed: Mar. 24, 1998

[51] Int. Cl.[7] ..... E04F 10/08

[52] U.S. Cl. ..... 160/36; 160/37; 160/201

[58] Field of Search ..... 160/201, 36, 31, 160/32, 133, 185, 205, 214, 221, 37

[56] References Cited

U.S. PATENT DOCUMENTS

| | | | |
|---|---|---|---|
| 550,653 | 12/1895 | Spaulding | 160/36 |
| 963,502 | 7/1910 | Bond | 160/37 |
| 1,220,405 | 3/1917 | Feitshans | 160/37 |
| 1,530,762 | 3/1925 | Dautrick . | |
| 1,626,844 | 5/1927 | Kuhn . | |
| 1,886,490 | 11/1932 | Lynch . | |
| 1,941,574 | 1/1934 | Nichols | 268/30 |
| 2,231,005 | 2/1941 | Gordon | 160/37 |
| 3,359,594 | 12/1967 | Pastoor | 16/178 |
| 3,616,575 | 11/1971 | Harris | 49/200 |
| 3,635,277 | 1/1972 | Bahnsen | 160/191 |
| 3,637,004 | 1/1972 | Wardlaw et al. | 160/133 |
| 3,934,635 | 1/1976 | Kin | 160/189 |
| 4,013,113 | 3/1977 | Frei | 160/36 |
| 4,147,197 | 4/1979 | Bailey et al. | 160/7 |
| 4,284,118 | 8/1981 | Ceron | 160/229 |
| 4,387,760 | 6/1983 | Greschbach | 160/229 |
| 4,436,136 | 3/1984 | Downey, Jr. | 160/232 |
| 4,460,030 | 7/1984 | Tsunemura et al. | 160/35 |
| 4,538,661 | 9/1985 | Henry et al. | 160/35 |
| 4,667,724 | 5/1987 | Dragone | 160/229 |
| 4,966,219 | 10/1990 | Sonolet | 160/37 |
| 5,239,776 | 8/1993 | Lhotak | 49/199 |

FOREIGN PATENT DOCUMENTS

| | | | |
|---|---|---|---|
| 372421 | 2/1938 | Italy | 160/36 |

*Primary Examiner*—Blair M. Johnson
*Attorney, Agent, or Firm*—Renner, Kenner, Greive, Bobak, Taylor & Weber

[57] ABSTRACT

In general, A collapsible cascading overhead door assembly (10) for closing a vehicular access opening of a structure includes a flexible door panel member (12) made up of a plurality of rigid slat members (13) each having a pair of hinge tab members (25, 26). A pair of elongated track members (15) having a generally G-shaped cross-section are affixed to an opening jamb (11) of the building structure, the flexible door panel member (12) being slidably disposed in the track members (15). A pair of flag bracket members (17) are affixed to the elongated track members (15). A support enclosure (16) is mounted on the flag brackets (17) and is adapted to maintain the door panel (12) in the stored position. An elongated, polygonal-shaped drive wheel member (66) has a plurality of sides (76) of equal width approximating the width of the rigid slat members (13). The sides (76) are angularly interconnected with one another to form a plurality of angular engaging faces (77) at the junction of the sides (76) and also to form a hollow portion inside the drive wheel (66). A drive bracket (65) rotatably supports the drive wheel (66), the drive bracket (65) with the drive wheel (66) supported therein, being mounted in the support enclosure (16) adjacent to the track members (17). A counterbalance (67) is disposed in the hollow portion of the drive wheel (66). The flexible door panel member (12) is pivotally affixed in the support enclosure (16) and drapes over the drive wheel (66) such that the hinge tabs (25, 26) of one of the slat members (13) operatively engages the angular engaging faces (77) of the drive wheel (66) whereby rotation of the drive wheel (66) in a first direction serves to raise the door panel (12) in the track members (15) and causes the door panel (12) to double back on itself in the support enclosure (16), and rotation of the drive wheel (66) in a second direction serves to cascade the door panel member (12) out of the support enclosure (16) and to lower the door panel member (12) in the track members (15).

25 Claims, 10 Drawing Sheets

COLLAPSIBLE CASCADING IMPACT-RESISTANT DOOR

TECHNICAL FIELD

The present invention relates generally to movable overhead doors, for garages or the like, adapted to protect and cover vehicular access openings. More particularly, the present invention relates to such doors which can be attachably stored in the ceiling area adjacent to the vehicular access opening on the inside of the building. Specifically, the present invention relates to a collapsible cascading garage door that operates quietly, that can be shipped in the fully assembled, collapsed position, and that tensions the counterbalance springs when the door is closed after being installed.

BACKGROUND ART

Movable overhead garage doors have been employed for many years. It is recognized as desirable to have a vehicular access door or opening cover that provides adequate protection against environmental elements, such as wind and rain, and that also prevents forced entry into the garage. Over the years, several types of doors have been developed to cover or control the openings to buildings where the openings are large enough to allow a vehicle to pass through.

The most common of these doors in the United States are sectional garage doors that have a series of panels or sections attached to one another by hinges. The panels are substantially vertically aligned when the door is closed and substantially horizontal when the door is open. A plurality of track rollers are attached at the sides of the sectional door and are rollingly journaled in tracks mounted inside the door opening. The tracks are disposed vertically at the sides of the door and curve near the top of the door opening thereby making a transition to be horizontally disposed along the garage ceiling. Thus, as the door is moved relative to the track, it is first moved upward and then inward as the panels or sections hinge at the transitional track curve. Accordingly the door is stored in the overhead area of the garage when in the open position. Further, the door may be counterbalanced by way of torsion and/or extension springs to assist in opening the door. This is accomplished by causing the springs to be tensioned such that the counterbalance tension equals the weight of the door when the door is closed.

In practice, several disadvantages have become apparent in conjunction with the use of such doors. The first of these disadvantages relates to the shipping and installation of the doors. Typically these door systems are shipped disassembled and, accordingly, in most situations must be assembled during installation. Initially, the track sections must be mounted in the door opening and in the ceiling area. The overhead track sections are, depending on the building structure, often positioned some distance from the ceiling, and the furthermost inward portion of the track must be supported from the ceiling by what is known as hanger brackets. Because building structures vary greatly from application to application, the hanger brackets typically must be cut to length to fit the application. After the track is installed, the individual panels are fitted in the door opening and attached together using the hinges. Then the counterbalance springs must be attached and adjustments made in track position, spring tension, and roller position, so as to ensure proper operation. Thus, the installation of such doors can be quite labor intensive.

Other disadvantages of the aforementioned doors relate to the operation and storage thereof. Sectional garage doors are often quite noisy due to the combination of rollers striking the guide track and hinges squeaking when opening or closing the door. While lubrication is helpful in reducing noise, it does not eliminate it. Additionally, sectional doors require a storage area in the overhead position of the building substantially equivalent to the size of the opening itself. Such space is sometimes unavailable and thus precludes the use of doors of this type.

A second type of garage door, most common in Europe, is a one-piece door comprising a single section that pivots around a point about midway up the vertical distance of the opening and somewhat inside the building. This type of door is also rollingly journaled in tracks mounted at the sides and top of the door and is also stored in the overhead area of the building. Accordingly, the one-piece door suffers from many of the same drawbacks as sectional doors.

Track systems have been developed for one-piece doors so as to reduce headroom requirements. This is accomplished by locating the pivot point of the door such that the top of the door section will move basically parallel with the ceiling. To accomplish this, however, the door must move significantly into the room or significantly outside the room when moving from closed to open and vice versa. Thus, the building must be deep enough to allow the intrusion of the door without striking a stored vehicle if the door moves inside the building, or clearance must be maintained outside the building if the door moves outside. As with sectional doors, reinforcing members added to the back of the door tend to cause the door to become more intrusive into the building both in the closed and open positions.

Another type of door commonly employed is essentially a modification of the one-piece door. The bi-folding door is made of two sections that fold in the center when the door is opened. The bi-folding door also suffers from many of the disadvantages of the aforementioned doors but requires a storage area only about half the depth of the one-piece door and about twice the thickness.

Yet another type of door is the folding door, which consists of a plurality of panels or sections that fold together when the door is in the open or stored position. While these types of doors significantly reduce the depth into which the door extends into the building when open, the thickness of the storage area is significantly increased, requiring a thickness approximately equal to the height of the panels or sections. Typically, such doors are shipped unassembled and are assembled during installation. Again, these types of doors tend to be quite noisy, having rollers and folding sections which pivotally contact one another. Further, due to the sections or panels folding together when stored, folding doors are limited in the amount of reinforcement that can be added without affecting the ability of the doors to fold together in the open or stored position. Also, due to the method of folding, the doors have a tendency to gather where hinged areas are not supported by track and lose their sealing abilities when experiencing wind velocity pressures.

Yet another type of opening cover for a garage door opening is a rolling door that consists of a plurality of slats or sections, which are relatively narrow in height and are rolled up on a storage drum when the door is open and in the stored position. The diameter of the storage drum is directly proportional to the height of the slat. Accordingly, the narrower the slat, the smaller the radius around which it can be stored, thus allowing the use of a smaller storage drum. The slats or sections are designed to pivot at the slat-to-slat interface so that storage on a round drum surface is possible. The area required to store a rolling door in the open position is a function of the height and thickness of the slats or sections. As the slats or sections increase in height, the diameter of the storage drum must become larger to prevent damage to the slats or sections of the door when the door is stored. Further, the thicker the slats or sections become, the greater the outside diameter of the stored door, thus increasing the area required to store the door when opened. Rolling doors can be shipped already assembled and wrapped around the storage drum. Installation requires setting the track system and drum support brackets, and then placing the storage drum with the door into the support brackets. Rolling doors can have rollers, but more often the slats are guided directly in the track. Accordingly, there is a considerable amount of noise generated from slat-to-slat contact and from slat-to-track contact during opening or closing of the door.

Some rolling doors, as described above, are limited in the amount of reinforcing that can be added without affecting the size of the storage area for the door in the open or stored position. It is common to use locking devices known as "windlocks," which are located on the portion of the slat or section that rides in the track system so as to transfer to the track system wind velocity pressure, thereby improving performance of the door during periods of high wind. However, these "windlocks" sometimes cause sections or slats to become jammed, thereby preventing the door from operating properly. On motor-driven rolling doors, the motor turns the storage drum, and the sections or slats not driven rely on gravity to pull the sections or slats into place. If an obstruction is encountered, the sections or slats have no place to go and become jammed against one another inside the roller barrel, which tends to severely damage the slats and/or track system. Such damage to the slats or sections can prevent the door from opening or closing properly.

In motor-operated rolling doors, the motor is commonly located inside the storage drum. Thus, any service to the motor requires disassembling the door and storage drum, resulting in an increase of labor and/or cost. Further, sealing the top of the door against the header of the opening requires the storage drum to be located significantly above the opening so that the door can be routed close to the header as the door uncoils from the drum and the diameter of the stored door decreases and the distance between the outside surface of the stored door on the storage drum and the header increases.

In recent years, there has been a greater awareness of the considerable damage caused to buildings and structures due to severe weather conditions. As such, garage door systems have come under scrutiny as a possible component of buildings that, if strengthened, could prevent further damage to the buildings. As a result of pressure from insurance companies and the public in general, building officials have taken steps in some geographic areas to increase building code requirements for resistance to wind and debris impact. Accordingly, designers of building components, such as garage doors, have attempted to improve wind and impact resistance by increasing door thickness and/or adding reinforcing trusses or beams to the backs of doors. However, such methods have seriously affected the weight of the door, thereby requiring heavier, stronger door components, such as springs and tracks, as well as reinforced structural support in the building itself. The need for such reinforcement has, therefore, increased labor and cost in installing such doors.

In many installations, especially in Europe, door openings are not standard. Thus, installers must either adapt the opening to fit the door or adapt the door to fit the opening. Of course, if the door is wider than the opening, the door must be cut to fit. If the door is a sectional, one-piece, or folding door, the end stiles may be removed and the panel(s) shortened by half the amount on each side to maintain the symmetry of the door. Changing the height of a sectional, one-piece, or folding door is difficult, and typically installers simply allow the door to extend above the opening on the inside of the structure rather than cutting the door down. Of the various door types discussed above, the rolling door can be most easily cut down in width and can have removable slats to adjust the height.

DISCLOSURE OF THE INVENTION

Therefore, a principal object of the present invention is to provide a door for closing a vehicular access opening in a structure such as a garage or the like.

Another object of the present invention is to provide such a door that is adapted to fit a variety of access openings having varying height and width dimensions.

A further object of the present invention is to provide such a door that is both wind- and impact-resistant and that still provides a secure seal of the access opening against wind, rain, and forced entry.

An additional object of the present invention is to provide such a door that may be manually operated or operated by a motor and drive assembly located externally of the door storage area for ease of servicing.

Yet another object of the present invention is to provide such a door that may be stored in a relatively small portion of the overhead ceiling area of the structure when the door is opened.

A still further object of the present invention is to provide such a door that may be shipped in a substantially assembled state in the open or stored condition.

Yet an additional object of the present invention is to provide such a door that tensions a counterbalance device to assist in opening the door.

Another object of the present invention is to provide such a door that is quiet in operation, lightweight and easy to install, and requires low maintenance.

An even further object of the present invention is to provide such a door that is inexpensive to manufacture and install using existing tools and known manufacturing techniques.

These and other objects of the present invention, as well as the advantages thereof over existing prior art forms, which will become apparent from the description to follow, are accomplished by the improvements hereinafter described and claimed.

In general, a collapsible, cascading overhead door assembly for closing a vehicular access opening of a structure includes a flexible door panel member, track members for guiding and supporting the flexible door panel member, a support enclosure for storing the flexible door panel member, and a drive unit for translating the flexible door panel member in the track members and doubling the door panel member back over itself for storage in the support enclosure.

A preferred exemplary door assembly incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
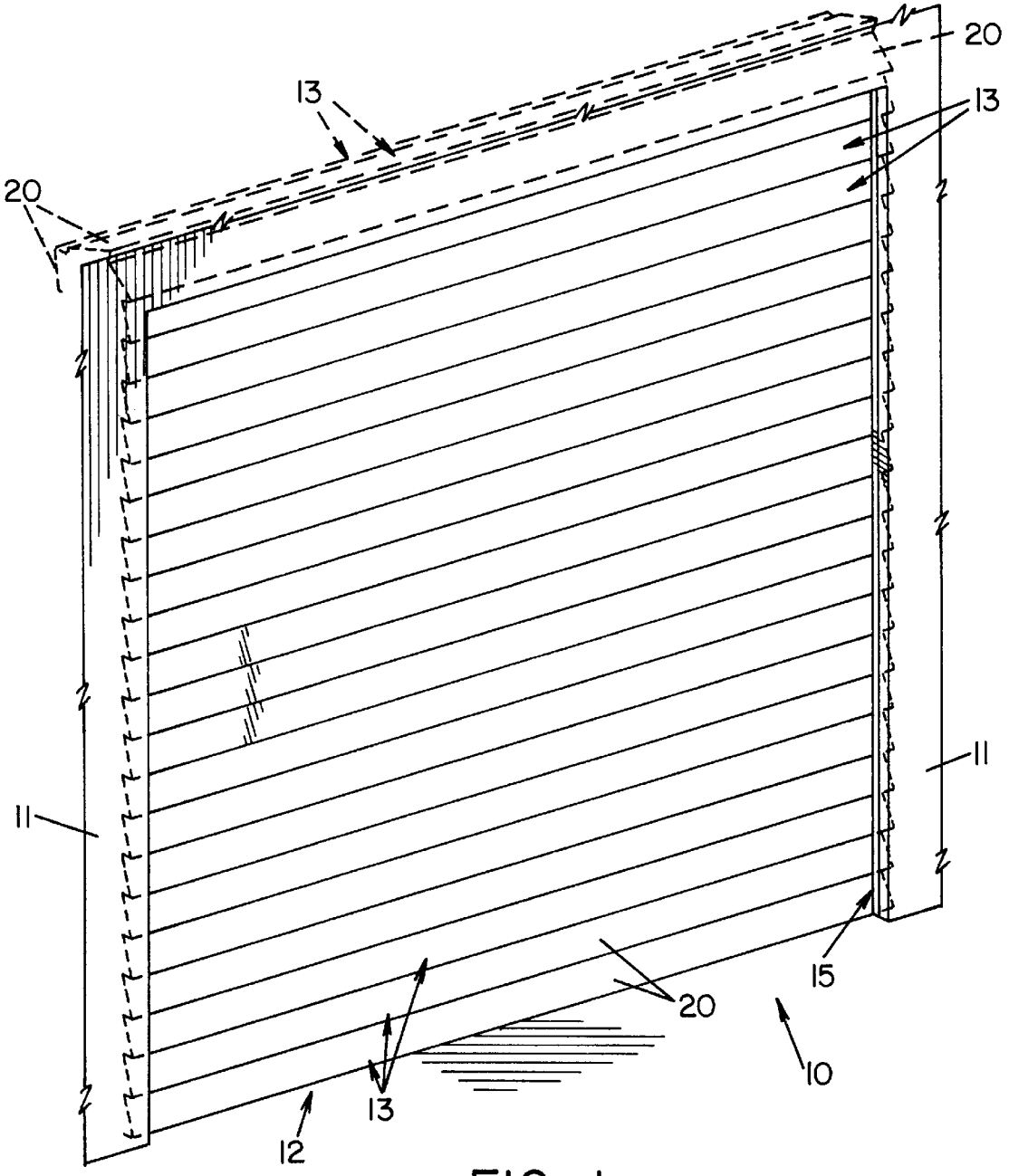
FIG. 1 is a perspective view of the outside of a door assembly according to the concepts of the present invention.
Figure 2:
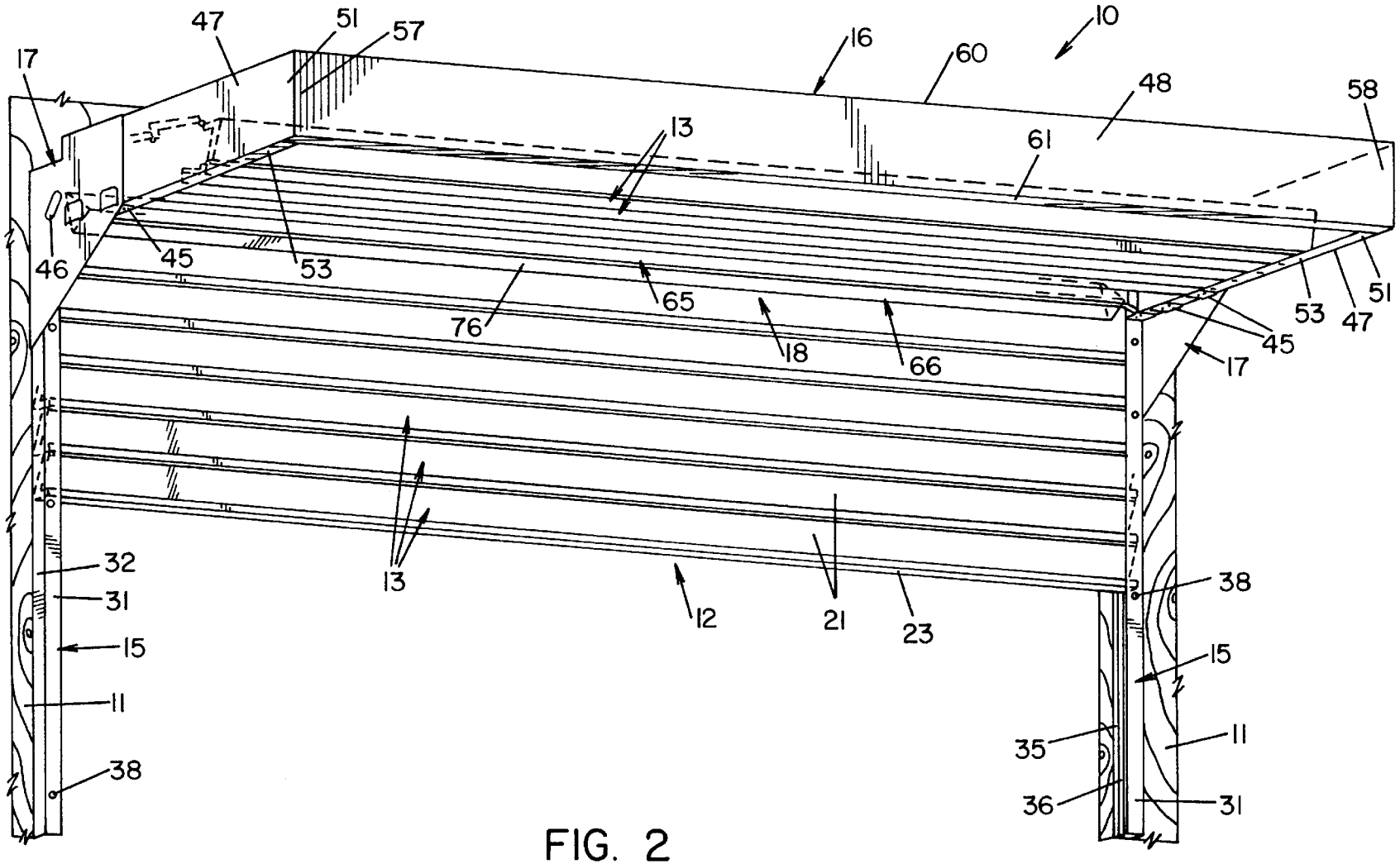
FIG. 2 is a perspective view of the inside of the door assembly of FIG. 1 shown in a partially closed position.
Figure 3:
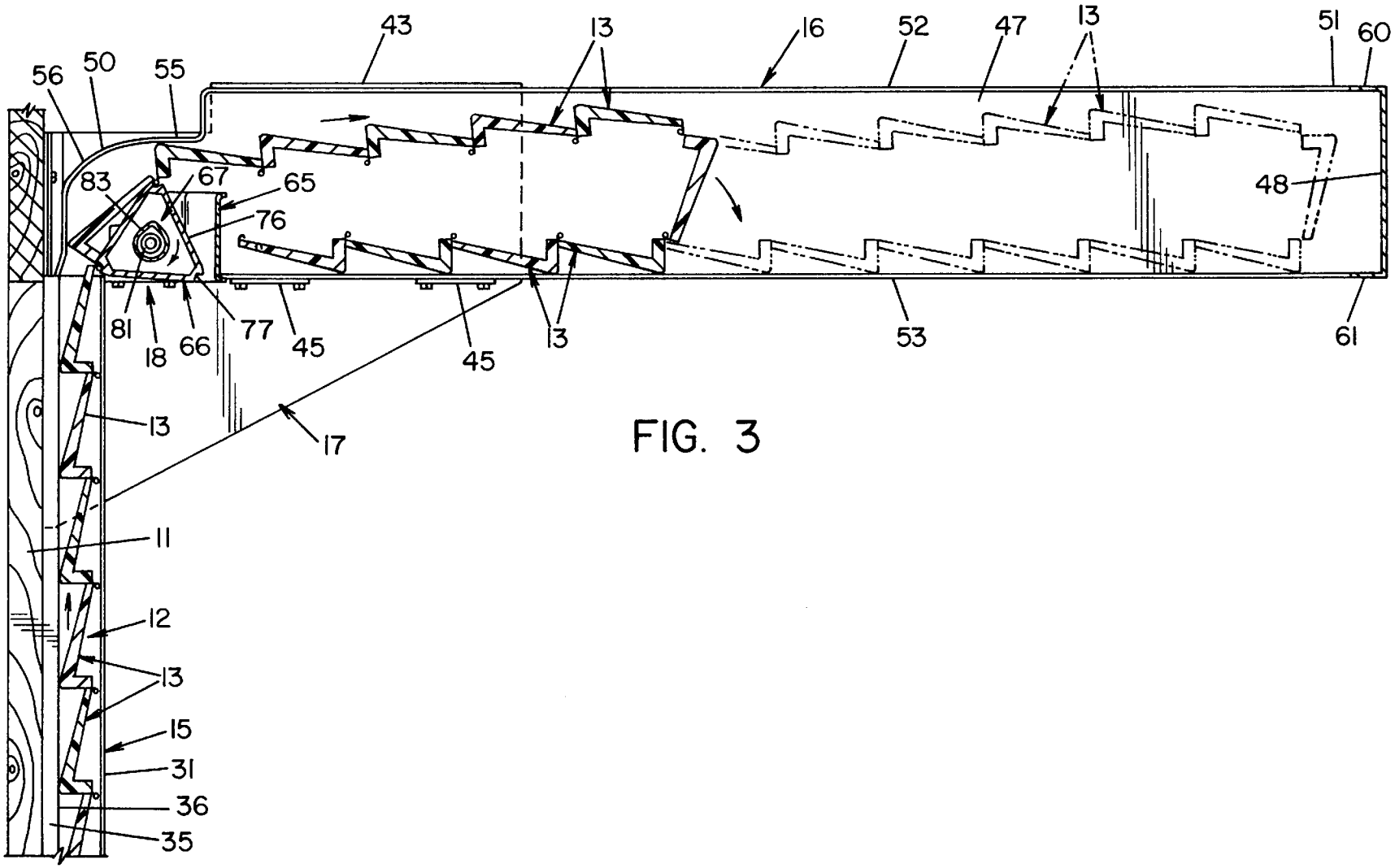
FIG. 3 is a fragmentary, cross-sectional, elevational view of the door assembly of FIG. 1 showing the door in a partially open position in solid lines and in a fully open position in chain lines.

A collapsible, cascading, impact-resistant door assembly according to the concepts of the present invention is indicated generally by the numeral 10 in the accompanying drawings. As shown, door 10 is adapted to cover a vehicular access opening of a structure, the opening being defined by a jamb 11. As best illustrated in FIGS. 1, 2, and 3, door assembly 10 includes a flexible panel member 12 made up of a plurality of individual slat members 13. Panel member 12 is supported by a pair of vertical track members 15 and horizontal support enclosure or box 16. Support box 16 is mounted to track members 15 by way of flag brackets 17. A drive unit, generally indicated by the numeral 18, is disposed in the front of support box 16 and is also affixed to flag brackets 17.

Figure 8:
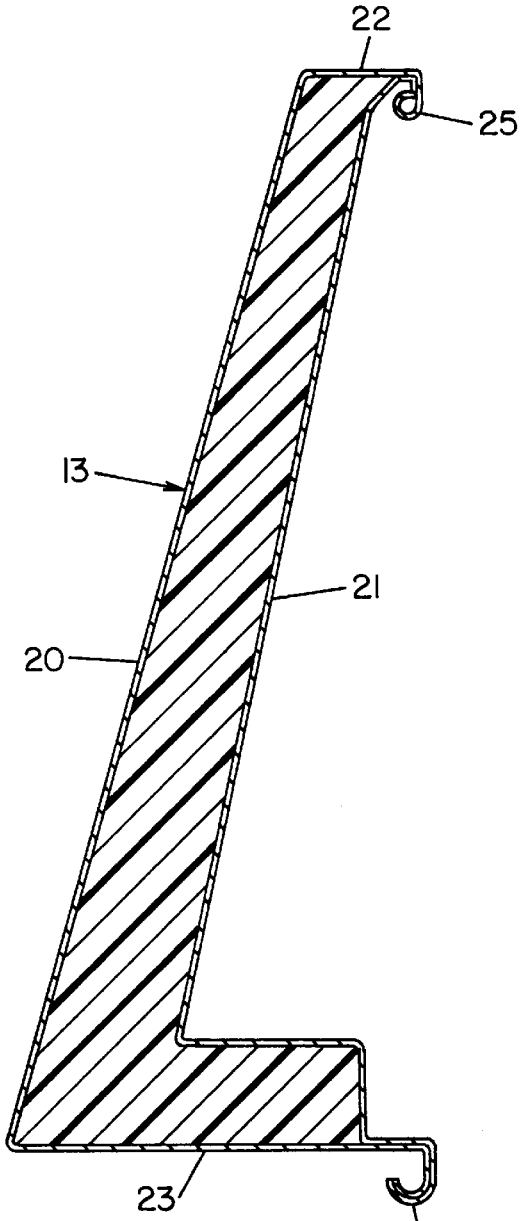
FIG. 8 is a cross-sectional side view of a slat member of the present invention.
Figure 9:
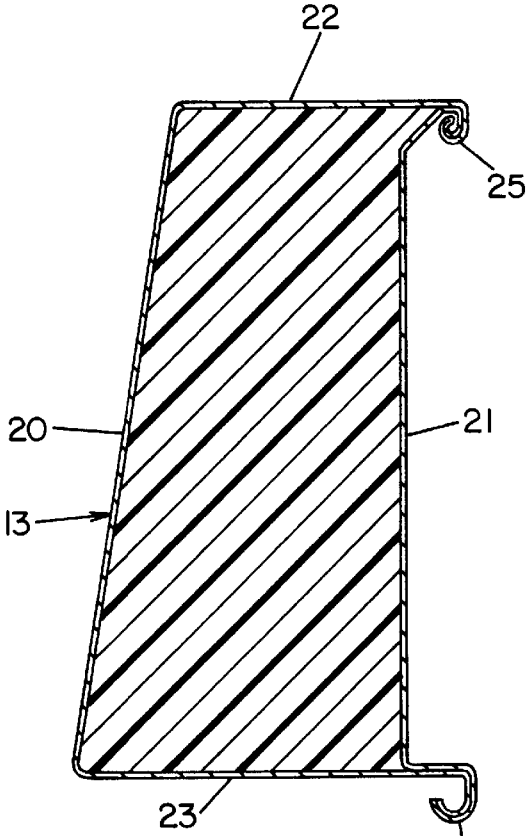
FIG. 9 is a cross-sectional side view of an alternative slat member of the present invention.
Figure 10A:
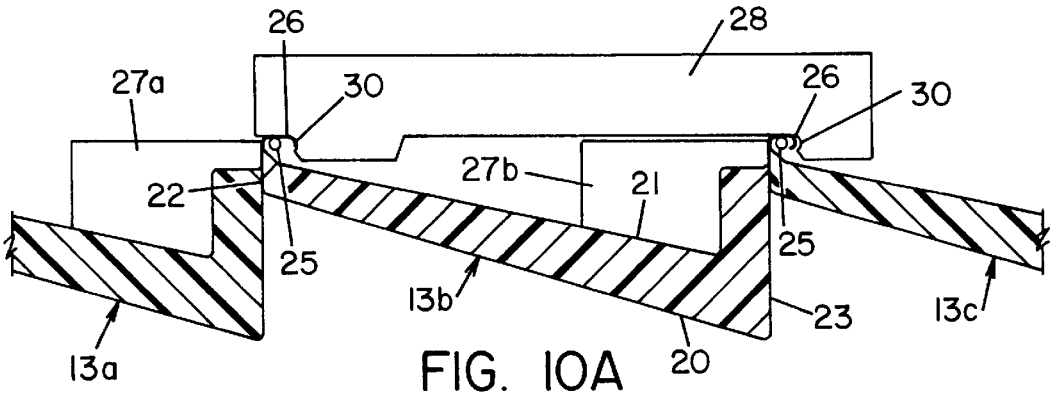
FIGS. 10A–10D are elevational views sequentially depicting the assembly of slat members.
Figure 10B:
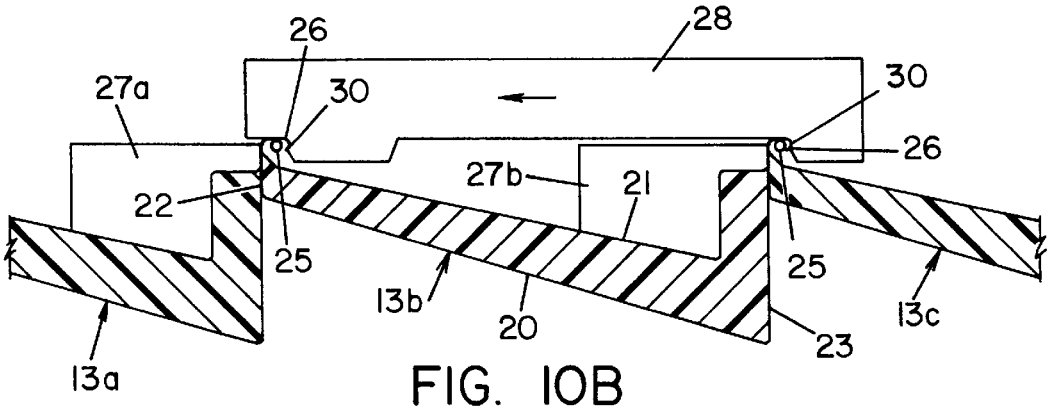
Figure 10C:
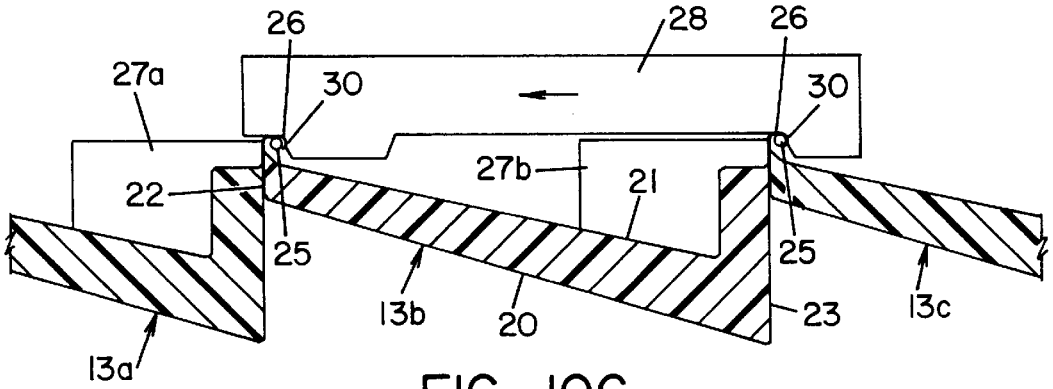
Figure 10D:
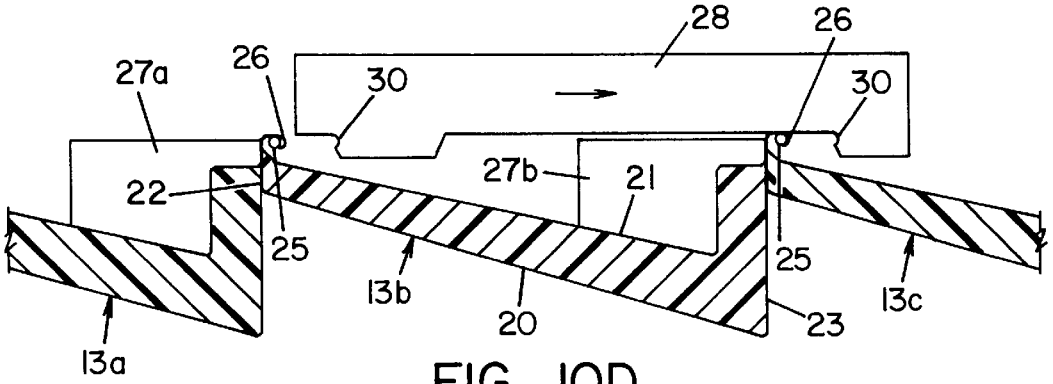
Figure 11A:
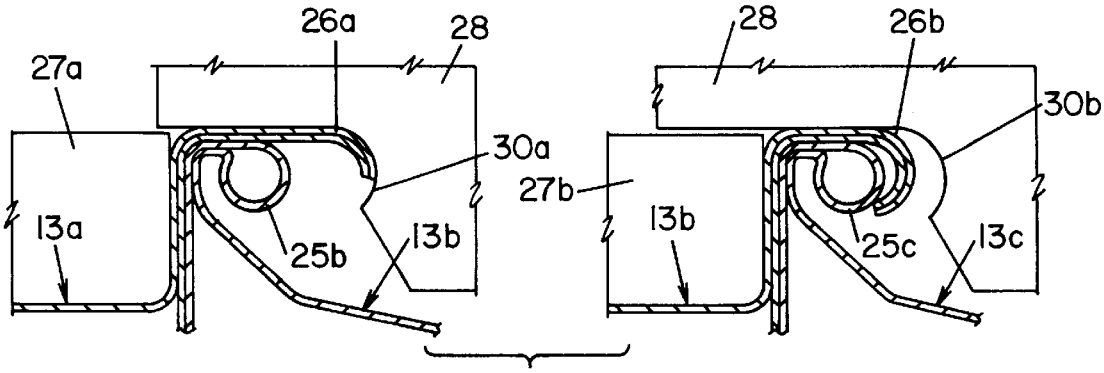
FIGS. 11A–11D are enlarged elevational views of the assembly process depicted in FIGS. 10A–10D.
Figure 11B:
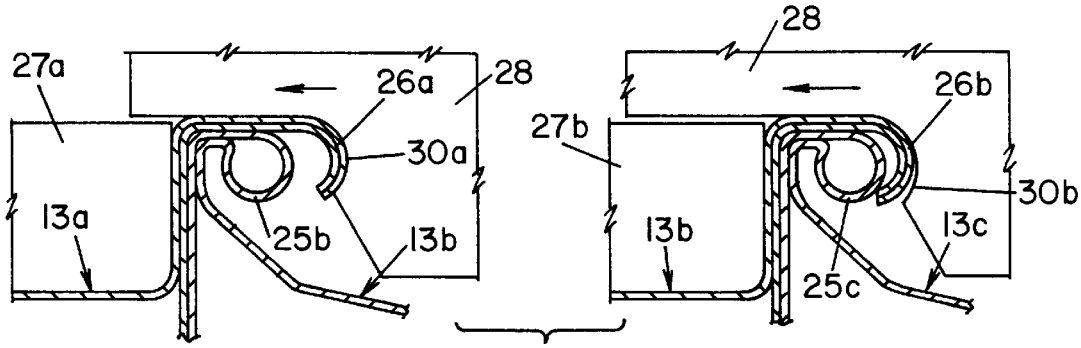
Figure 11C:
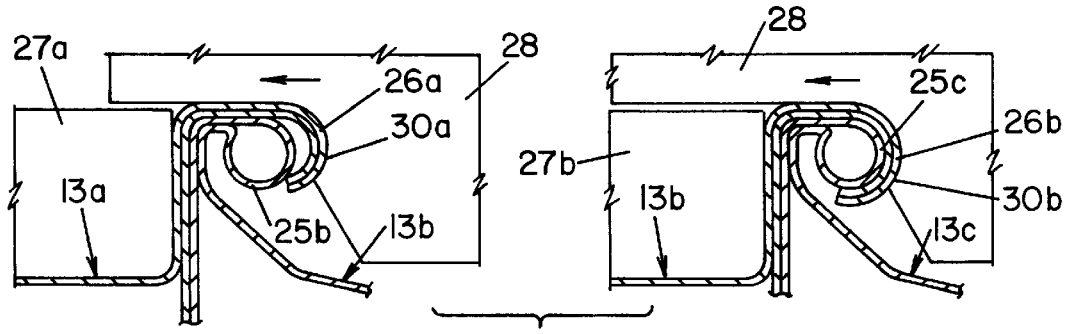
Figure 11D:
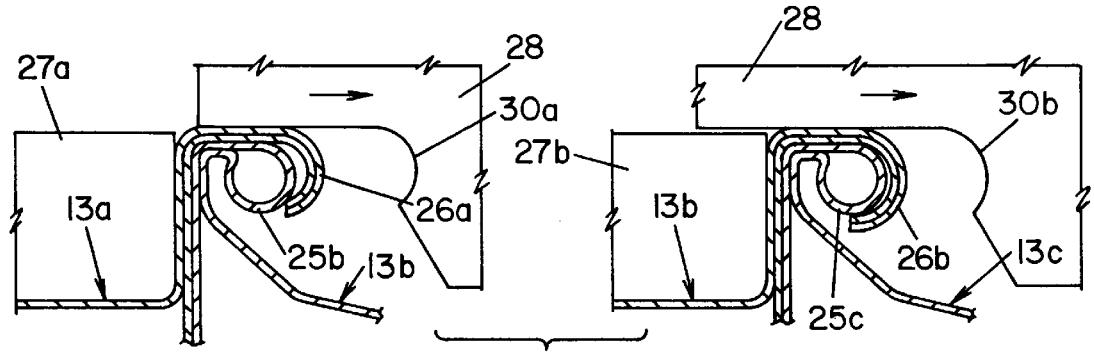

As shown, panel member 12 includes a plurality of slats 13. While slats 13 may be made in a variety of different profiles and still accomplish the objects of the invention, only the preferred profile shown will be described in detail. With reference to FIGS. 8 and 9, which depict alternative slat profiles, each slat 13 includes a front face 20, a rear face 21, a top face 22, and a bottom face 23. A male hinge tab member 25 is formed proximate the point where top face 22 meets rear face 21. Similarly, a female hinge tab member 26 is formed proximate the point where bottom face 23 meets rear face 21. Accordingly, slats 13 are engaged to one another by crimping female hinge tab member 26 of a first slat 13*a* around male hinge tab member 25 of a second adjacent slat 13*b*.

The crimping process is depicted in FIGS. 10 and 11. As shown, a first slat 13*a* is seated against a first anvil 27*a*, while a second slat 13*b* is seated against a second anvil 27*b*. Male hinge tab 25*b* of second slat 13*b* is abutted to female hinge tab 26*a* of first slat 13*a*, while male hinge tab 25*c* of third slat 13*c* abuts female hinge tab 26*b* at second slat 13*b*. A die 28 is then brought into simultaneous engagement with female hinge tabs 26*a* and 26*b* of slats 13*a* and 13*b*, respectively. Die 28 has a pair of identical arcuate crimping faces 30*a* and 30*b* spaced apart at a distance corresponding to the length of the individual slats 13. As will be apparent from FIGS. 10 and 11, as die 28 is translated laterally (in the direction of the arrows in FIGS. 10B, 10C, 11B and 11C), arcuate crimping faces 30 come into engagement with female hinge tabs 26. Further, lateral translation of die 28 causes female hinge tabs 26 to conform to the shape of the arcuate crimping faces 30 thereby curling female hinge tabs 26 around male hinge tabs 25. When hinge tabs 25 and 26 are crimped to the extent shown in FIG. 11D, die 28 is translated in the opposite lateral direction (as illustrated by the arrows in FIGS. 10D and 11D). Thereafter, the juncture of slats 13*a* and 13*b* is indexed to the right, as seen in FIGS. 10 and 11, and die 28 is again actuated whereby the crimping face 30*b* engages the juncture to complete the crimping engagement, as seen at the right-hand side of FIG. 11D. Further, the crimping engagement of the hinge tabs 25, 26 permits slats 13 to hingeably pivot relative to one another.

Figure 7:
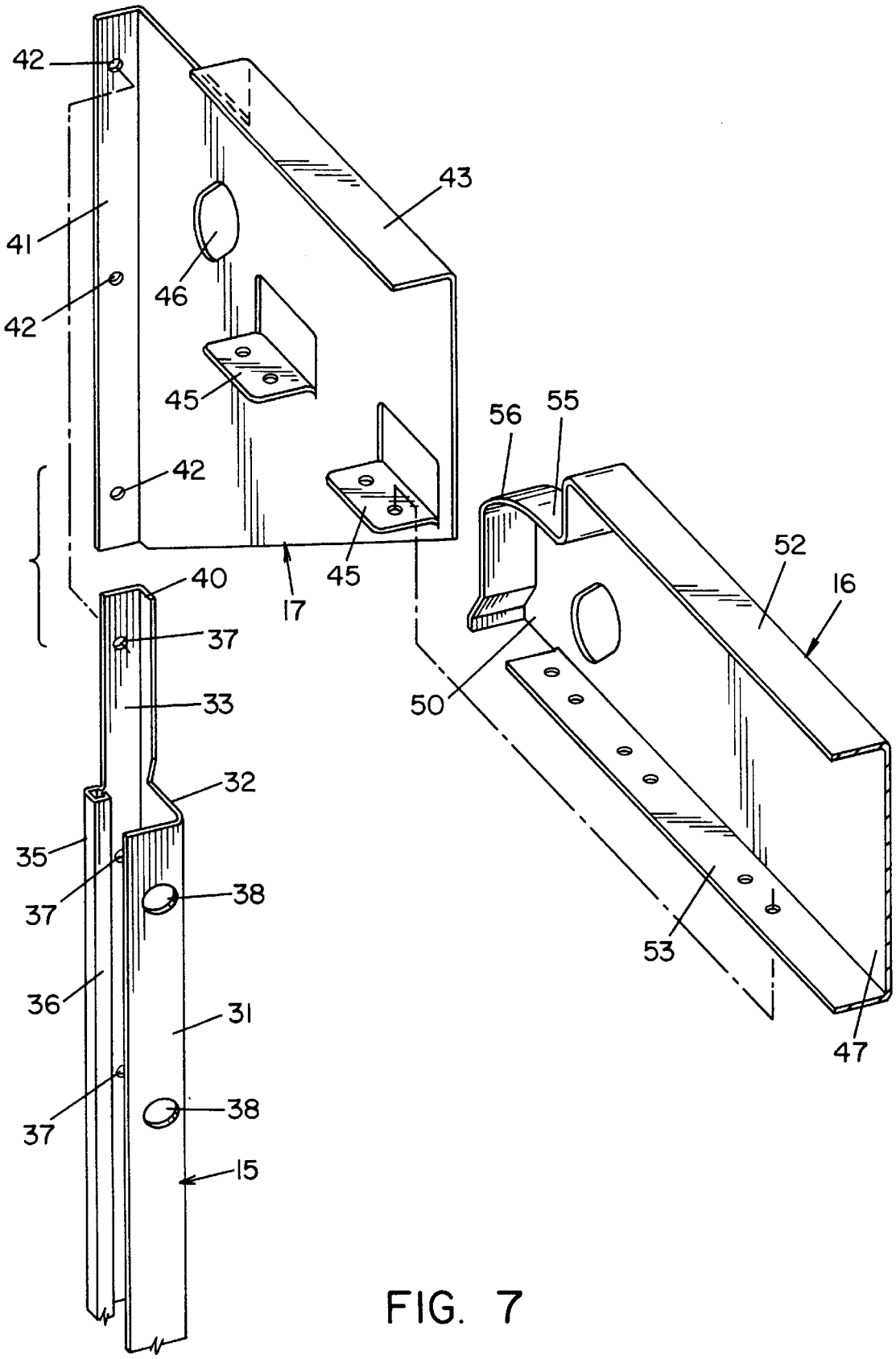
FIG. 7 is an exploded perspective view of the track and support assembly of the present invention.

With reference to FIG. 7, it can be seen that track members 15 according to the present invention are elongated members made of a galvanized steel or other appropriate material and have a generally G-shaped cross-section. As such, each track member 15 has a first wall 31, a second wall 32 disposed at a right angle to the first wall 31, a third wall 33 at a right angle to the second wall 32 and opposite the first wall 31, a short fourth wall 35 disposed at a right angle to the third wall 33 and opposing the second wall 32, and a fifth wall 36 at a right angle to the fourth wall 35 and also parallel to the first and third walls 31 and 33, respectively. A plurality of screw apertures 37 are disposed in third wall 33 to facilitate mounting of track member 15 to jamb 11. Similarly, a plurality of screw access apertures 38 are provided in first wall 31, each aperture 38 being located directly opposite a screw aperture 37 in third wall 33 so as to permit access to mounting screws with appropriate tools. For reasons which will become apparent as the description continues, upper end 40 of track member 15 is partially cut away. Specifically, only portions of second and third walls 32 and 33, respectively, extend the full length of track member 15.

Flag brackets 17 are formed of a generally flat, polygonal sheet of galvanized steel or other appropriate material. A front edge is bent at a right angle to the sheet to form a mounting flange 41. As shown, mounting flange 41 includes a plurality of screw apertures 42 to facilitate mounting of bracket 17 to jamb 11 and/or track member 15. The upper edge of bracket 17 is bent at a right angle to form a support box flange 43. Similarly, a pair of support box tabs 45 are bent at a right angle from the bracket parallel to and directly opposite support box flange 43. An oval drive aperture 46 is disposed in bracket 15, preferably proximal to mounting flange 41 and approximately midway between support box flange 43 and support box tabs 45.

Referring now to FIGS. 2 and 3, support box 16, as shown, has a pair of end-frame members 47 and a cross-frame member 48. End-frame members 47 are of a generally elongated rectangular shape having a first end 50 and a second end 51. Both the upper and lower edges of each end-frame member 47 are bent at a right angle to form upper and lower support flanges 52 and 53, respectively. As can be seen in the drawings, each of end-frame members 47 have a stepped portion 55 proximate to first ends 50 thereof. Stepped portion 55 terminates on a plane parallel to upper support flange 52, progressing to form a curved end flange 56. Cross-frame member 48 of support box 16 is similar to end-frame members 47 in that it is of an elongated, rectangular shape having first and second ends 57 and 58, respectively, and upper and lower support flanges 60 and 61, respectively. Further, cross-frame member 48 has end flanges 62 and 63 at the respective first and second ends 57 and 58 thereof. Accordingly, end-frame members 47 matingly engage cross-frame member 48, as shown, to form a partial box-shaped configuration.

Referring now to FIGS. 3–6, the drive unit 18 depicted in the drawings has a drive wheel 66, a drive bracket 65, and a counterbalance member 67. As shown, drive bracket 65 includes an elongated main body portion 68. The ends of the main body portion 68 are bent at right angles thereto to form a pair of perpendicular end portions 70. Each end portion 70 has a mounting flange 71 at the bottom edge thereof and extending perpendicularly outward therefrom. Mounting flange 71 includes a pair of fastener apertures 72 disposed therein. Further, end portions 70 include angularly-disposed journal slots 73 for reasons which will become apparent as the description continues. Drive bracket 65 may further include a curved lip 75 along the length of both the upper and lower edges thereof.

Drive wheel 66 is a three-sided, elongated member having equilateral sides 76 so as to form a generally triangular shape. At each of the three vertices 76' of triangular-shaped wheel 66, there is formed an angular, V-shaped engaging groove 77 which runs substantially the entire length of each drive wheel 66. It will be noted that drive wheel 66 has a hollow interior that may be closed by end plugs 78 adapted to fit in the ends of drive wheel 66, as shown. It should also be noted that at least one of end plugs 78 may include a drive gear 80 for reasons which will become apparent as the description continues.

Counterbalance member 67 is a torsion spring counterbalance of a known type, such as that disclosed and described in Mullet U.S. Pat. No. 5,419,010. Accordingly, counterbalance member 67 includes a torsion spring 81 having one end affixed to a winding tube 82 and having the other end affixed to a torsion tube 83. In the present invention, counterbalance member 67 is mountably disposed in the hollow interior of drive wheel 66 by end plugs 78, such that torsion tube 83 is rotationally affixed to drive wheel 66. As such, counterbalance member 67 supporting drive wheel 66, is journaled in slot 73 of drive bracket 65 by way of winding tube 82, which is rotationally affixed to drive bracket 65.

The collapsible, cascading, impact-resistant door 10 is assembled by attaching flag brackets 17 to track members 15 by way of appropriate fasteners. Then support box 16 and drive bracket 65 may be mounted to flag brackets 17 as shown. It will be apparent from the drawings that drive bracket 65 is disposed in the front of support box 16 opposite cross-frame member 48 so as to form a front support for support box 16. Accordingly, drive bracket 65 is mounted to both support box 16 and flag bracket 17 by way of mounting flange 71 using appropriate fasteners. It will also be apparent that support box 16 is interposed between support box flange 43 and support box tabs 45 and affixed thereto so as to be securely supported by flag brackets 17. Door panel 12 is pivotally affixed at its upper slat member 13 in end-frame member 47 of support box 16. Door panel 12 is draped over drive wheel 66 such that hinge tabs 25, 26 are aligned for driving engagement in one of angular engaging grooves 77 of drive wheel 66. Door panel 12 is further disposed in track members 15, such that the ends of adjacent slats 13 are slidably interposed between first and fifth walls 31 and 36, respectively, of track members 15. Track members 15, with support box 16 and door panel 12 mounted thereto, may then be securely affixed to jamb 11 using appropriate fasteners.

Figure 4:
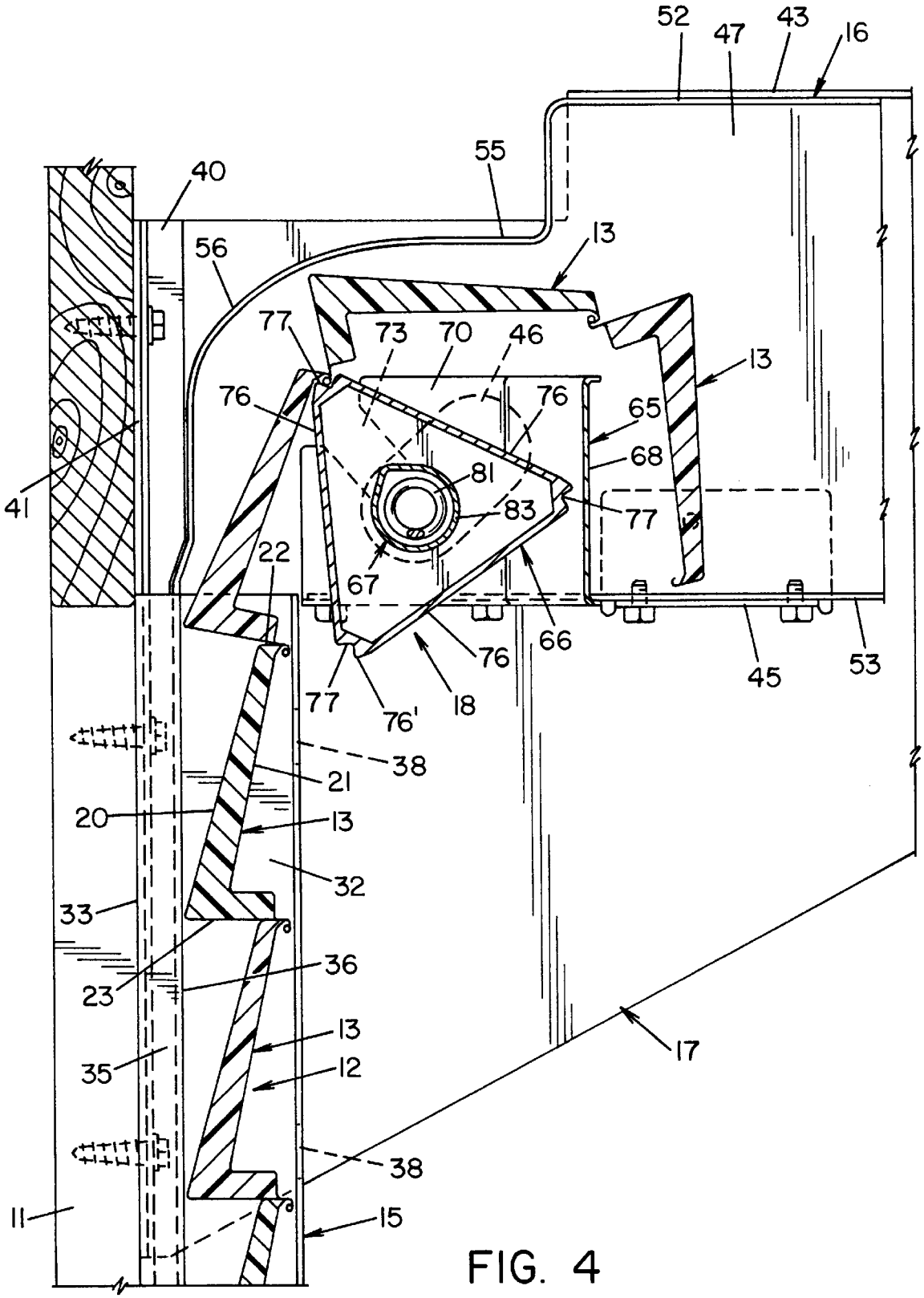
FIG. 4 is an enlarged, fragmentary, cross-sectional, elevational view of the door assembly of the present invention in the area proximate the drive unit.
Figure 5:
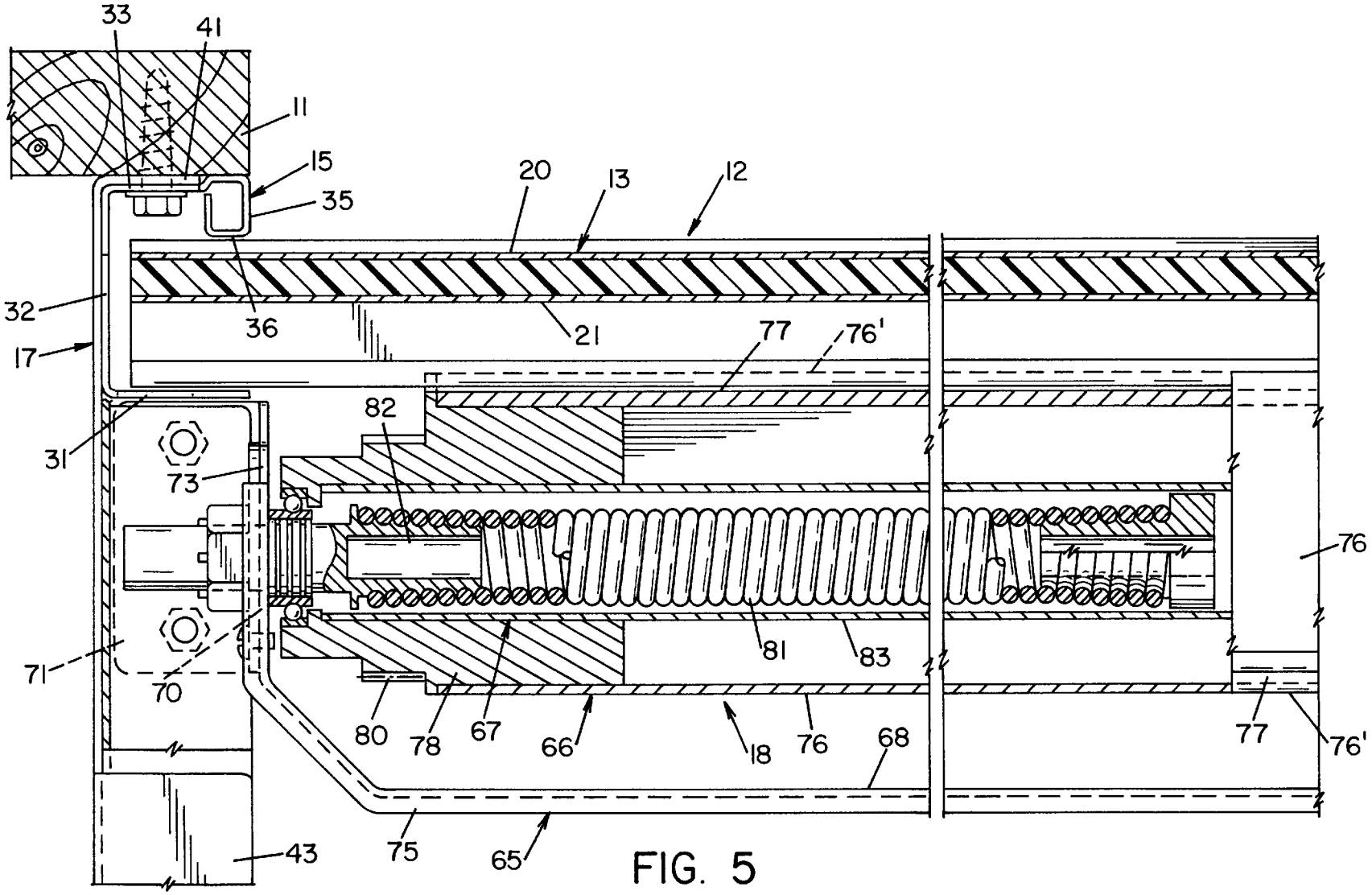
FIG. 5 is a cross-sectional plan view of the drive unit of the present invention.
Figure 6:
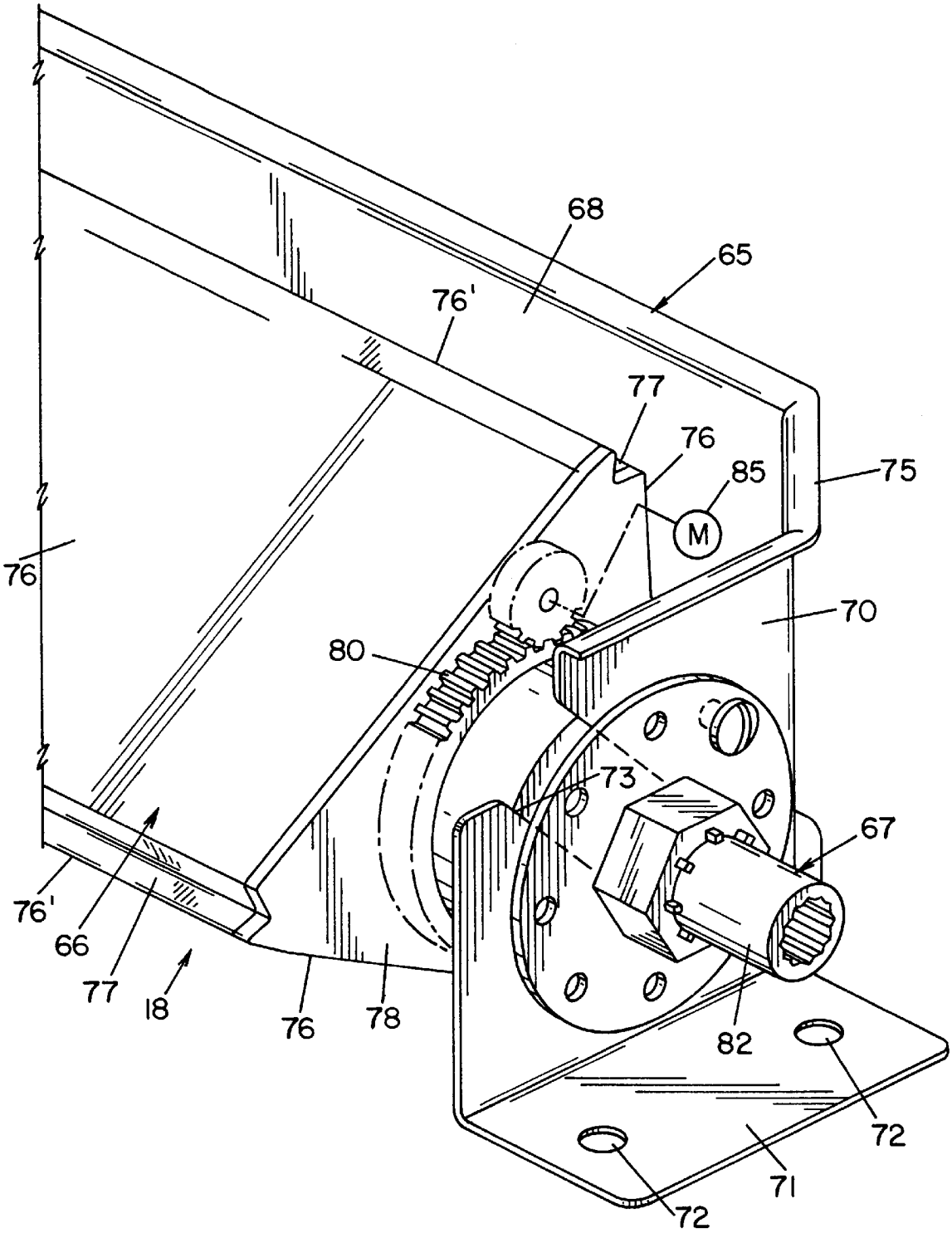
FIG. 6 is a fragmentary, perspective partial view of the drive unit of the present invention.

In view of the foregoing, the manner in which door 10 operates should now be apparent. Referring to FIGS. 3 and 4, as door panel 12 is slidably raised or lowered relative to vertical track members 15, the successive hinge tabs 25, 26 engage angular grooves 77 in drive wheel 66, causing drive wheel 66 to rotate relative to drive bracket 65. As illustrated in FIGS. 3 and 4, curved end flanges 56 of end-frame members 47, in conjunction with curved main body portion 68 of the drive bracket 65, serve to hold the slat members 13 of the door panel 12 in engagement with the drive wheel 66. Thus, rotation of drive wheel 66 causes counterbalance 67 to tension when door panel 12 is lowered, thus causing torsion spring 81 to wind. Thus, when door panel 12 is raised, tension in torsion spring 81 is released, thereby assisting in lifting door panel 12. It should further be apparent that by drivingly rotating drive wheel 66, door panel 12 may be selectively raised or lowered in track members 15, thereby opening or closing the vehicular access opening of the structure. Accordingly, it is contemplated that a drive motor 85 or other appropriate manual drive means may be operatively connected to drive wheel 66 such as by way of drive gear 80 integrated on end plug 78, as discussed previously.

An aspect of the present invention is the manner in which door panel 12 is stored when the door is in the raised or open position. As noted previously, uppermost slat 13 of door panel 12 is pivotally affixed in support box 16. Thus, when the door is raised, successive slats 13 engage and then disengage drive wheel 66. As slats 13 disengage drive wheel 66, they pass into support box 16 and double back on one another for storage in support box 16, as shown in FIGS. 2 and 3. Accordingly, panel 12 may be stored in a substantially smaller area than was previously possible with known door systems.

Thus, it can be seen that the objects of the present invention have been accomplished by the collapsible, cascading, impact-resistant door system disclosed herein. Specifically, it has been found that reinforcing and/or insulation may be added to the door panel without interfering with the ability of the door to store properly due to the unique manner in which the door is stored. As such, the door may be made to be substantially weather and impact resistant. It will also be apparent that the door panel may be shipped assembled in the support box in the open or stored position thereby eliminating the need for complex assembly of the door at the installation location. Similarly, excess length in the door panel may be stored in the support box when the door is closed thereby eliminating the need to cut the door to size. The interior storage space required is also substantially less than that required by known door systems, due to the unique manner in which the door is stored.

I claim:

1. A collapsible, cascading overhead door assembly for closing a vehicular access opening of a structure comprising:

a flexible door panel member;

vertical track members for guiding and supporting said flexible door panel member;

an enclosure for storing said flexible door panel member extending substantially horizontally from said track members;

a plurality of slats in said flexible door panel member pivotally attached to adjacent slats and an end slat pivotally attached within said enclosure; and a drive unit for translating said flexible door panel member in said track members and doubling said door panel member back over itself to form two horizontally-disposed rows of said slats spaced by a single said slat for storage in said enclosure.

2. A collapsible, cascading overhead door assembly according to claim 1, wherein said plurality of slat members have hinge tabs for connecting said slat members together.

3. A collapsible, cascading overhead door assembly according to claim 2, wherein said hinge tab means has a female hinge tab on a first said slat member crimpingly engaged to a male hinge tab on a second said slat member.

4. A collapsible, cascading overhead door assembly for closing a vehicular access opening of a structure comprising:

a flexible door panel member;

track members for guiding and supporting said flexible door panel member;

a support enclosure for storing said flexible door panel member; and a drive unit for translating said flexible door panel member in said track members and doubling said door panel member back over itself for storage in said support enclosure, said track members comprising a pair of elongated track members having a generally G-shaped cross section.

5. A collapsible, cascading overhead door assembly according to claim 1, wherein said track members further comprise a pair of flag bracket members having at least one support flange and at least one support tab opposing said at least one support flange.

6. A collapsible, cascading overhead door assembly according to claim 1, wherein said enclosure comprises a pair of opposing side-frame members, each having an upper support flange and a lower support flange.

7. A collapsible, cascading overhead door assembly according to claim 6, wherein said enclosure further comprises a cross-frame member having an upper support flange and a lower support flange, said cross-frame member connectively interposed between said side-frame members.

8. A collapsible, cascading overhead door assembly according to claim 2, wherein said drive unit comprises an elongated, polygonal-shaped drive wheel member and a drive wheel support bracket, said drive wheel member rotatably supported in said drive wheel bracket.

9. A collapsible, cascading overhead door assembly according to claim 8, wherein said drive wheel member has a plurality of equally sized sides angularly interconnected with one another and a plurality of angular engaging grooves being formed at the junction of said sides.

10. A collapsible, cascading overhead door assembly for closing a vehicular access opening of a structure comprising:

a flexible door panel member;

track members for guiding and supporting said flexible door panel member;

a support enclosure for storing said flexible door panel member; and a drive unit for translating said flexible door panel member in said track members and doubling said door panel member back over itself for storage in said support enclosure, said drive unit including a drive wheel member having an interior hollow portion with a spring means for counterbalancing said door panel member disposed therein.

11. A collapsible, cascading overhead door assembly according to claim 10, wherein said spring means comprises a torsion tube member, a winding tube member, and a torsion spring member operatively connected to said torsion tube member and said winding tube member.

12. A collapsible, cascading overhead door assembly according to claim 5, wherein said track members and said flag bracket members are attached to the jamb of the vehicular access opening and said enclosure is interposed between said support flanges and said support tab of said flag bracket.

13. A collapsible, cascading overhead door assembly according to claim 8, wherein said drive wheel support bracket, with said drive wheel supported therein, is mounted in said enclosure adjacent to said track means.

14. A collapsible, cascading overhead door assembly according to claim 9, wherein said flexible door panel member is pivotally affixed to said support enclosure and is draped over said drive wheel such that said hinge tabs operatively engage said angular engaging grooves of said drive wheel, whereby rotation of said drive wheel serves to translate said door panel member in said track members and in said support enclosure.

15. A collapsible, cascading overhead door assembly according to claim 14, wherein said flexible door panel member is slidably disposed in said track members.

16. A collapsible, cascading overhead door assembly according to claim 15, wherein rotation of said drive wheel in a first direction serves to raise said door panel member in said track members causing said door panel member to double back on itself in said support enclosure and rotation of said drive wheel in a second direction serves to cascade said door panel member out from said support enclosure and to lower said door panel member in said track members.

17. A collapsible, cascading overhead door assembly according to claim 16, wherein rotation of said drive wheel in said first direction serves to release tension in said spring means and rotation of said drive wheel in said second direction serves to tension said spring means.

18. A collapsible, cascading overhead door assembly according to claim 1, wherein said slats are insulated.

19. A collapsible, cascading overhead door assembly according to claim 17, wherein said drive unit further comprises a drive motor and drive gear assembly operatively connected to said drive wheel.

20. A collapsible, cascading overhead door assembly for closing a vehicular access opening of a structure comprising:

a flexible door panel member;

track means for guiding and supporting said flexible door panel member;

support box means for storing said flexible door panel member; and drive means for translating said flexible door panel member in said track means and doubling said door panel member back over itself for storage in said support box means, wherein said drive means includes an elongated, polygonal-shaped drive wheel member and a drive wheel support bracket, said drive wheel member rotatably supported in said drive wheel support bracket.

21. A collapsible, cascading overhead door assembly according to claim 20, wherein said drive wheel member has a plurality of sides of equal size angularly interconnected with one another and a plurality of angular engaging grooves being formed at the junction of said sides.

22. A collapsible, cascading overhead door assembly according to claim 21, wherein said flexible door panel member is pivotally affixed to a support box means and is draped over said drive wheel such that said hinge tab means operatively engage said angular engaging surfaces of said drive wheel, whereby rotation of said drive wheel serves to translate said door panel member in said track means and in said support box means.

23. A collapsible, cascading overhead door assembly according to claim 22, wherein rotation of said drive wheel in a first direction serves to raise said door panel member in said track members causing said door panel member to double back on itself in said support box and rotation of said drive wheel in a second direction serves to cascade said door panel member out from said support box and to lower said door panel member in said track members.

24. A collapsible, cascading overhead door assembly for closing a vehicular access opening of a structure, comprising:

a flexible door panel member comprised of a plurality of rigid slat members each having a female hinge tab member and a male hinge tab member, said female hinge tab member of one of said plurality of rigid slat members crimpingly engaging said male hinge tab member of another of said plurality of rigid slat members;

a pair of elongated track members having a generally G-shaped cross-section and being affixed to an opening jamb of the building structure, said flexible door panel member being slidably disposed in said track members;

a pair of flag bracket members affixed to said elongated track members, each said flag bracket member having at least one support flange and at least one support tab opposing said at least one support flange;

a support box comprising a pair of opposed side-frame members and a cross-frame member, each of said side-frame members and said cross-frame members having an upper support flange and a lower support flange, said cross-frame member connecting said opposed side-frame members to form said support box member, and said support box member being interposed between said support flange and said support tab of said support box;

an elongated, polygonal-shaped drive wheel member having a plurality of sides of equal width approximating the width of said rigid slat members, said sides angularly interconnected with one another to form a plurality of angular engaging faces at the junction of said sides and also forming a hollow portion inside said drive wheel;

a drive bracket for rotatably supporting said drive wheel, said drive bracket with said drive wheel supported therein being mounted in said support box adjacent to said track members;

a counterbalance disposed in said hollow portion of said drive wheel, said counterbalance having a torsion tube, a winding tube, and a torsion spring interconnected between said torsion tube and said winding tube, said torsion tube being affixed to said drive wheel and said winding tube being affixed to said drive bracket such that rotation of said drive wheel in a first direction serves to tension said torsion spring and rotation of said drive wheel in a second direction serves to release tension in said torsion spring; and said flexible door panel member pivotally affixed in said support box and draped over said drive wheel such that said hinge tabs of one said slat member operatively engages the angular engaging faces of said drive wheel, whereby rotation of said drive wheel in a first direction serves to raise said door panel in said track members and causes said door panel to double back on itself in said support box and rotation of said drive wheel in a second direction serves to cascade said door panel member out of said support box and to lower said door panel member in said track members.

25. A collapsible, cascading overhead door assembly for closing a vehicular access opening of a structure comprising:

a flexible door panel member;

track members for guiding and supporting said flexible door panel member;

an enclosure for storing said flexible door panel member extending substantially horizontally from said track members; and a drive unit including an elongated, polygonal-shaped drive wheel rotatably mounted on a support bracket for translating said flexible door panel member in said track members and doubling said door panel member back over itself for storage in said enclosure.

* * * * *